US005951413A

United States Patent [19]

Guerriero

[11] Patent Number: 5,951,413

[45] Date of Patent: Sep. 14, 1999

[54] PRACTICE BATTING TEE AND A METHOD THEREOF

[76] Inventor: Salvatore Guerriero, 2942 Cylston Rd., Norristown, Pa. 19403

[21] Appl. No.: 08/903,155

[22] Filed: Jul. 30, 1997

[51] Int. Cl.[6] ..... A63B 69/40

[52] U.S. Cl. ..... 473/417

[58] Field of Search ..... 473/417, 387, 473/397, 145, 149

[56] References Cited

U.S. PATENT DOCUMENTS

| | | | |
|---|---|---|---|
| 2,616,692 | 11/1952 | Bird . | |
| 2,652,250 | 9/1953 | Alder et al. . | |
| 2,976,041 | 3/1961 | White . | |
| 3,118,670 | 1/1964 | Smith . | |
| 3,271,030 | 9/1966 | Mueller . | |
| 4,227,691 | 10/1980 | Lefebvre et al. . | |
| 4,445,685 | 5/1984 | Cardieri . | |
| 4,456,250 | 6/1984 | Perrone | 473/417 |
| 4,516,771 | 5/1985 | Nau . | |
| 4,575,080 | 3/1986 | Miles . | |
| 4,709,924 | 12/1987 | Wilson et al. . | |
| 4,796,885 | 1/1989 | Wright . | |
| 4,819,937 | 4/1989 | Gordon . | |
| 4,886,267 | 12/1989 | Licciardi et al. . | |
| 5,004,234 | 4/1991 | Hollis . | |
| 5,076,580 | 12/1991 | Lang . | |
| 5,087,039 | 2/1992 | Laseke . | |
| 5,106,085 | 4/1992 | Lewy | 473/417 |
| 5,322,276 | 6/1994 | Hardison, Jr. . | |
| 5,435,545 | 7/1995 | Marotta . | |
| 5,467,979 | 11/1995 | Zarate . | |
| 5,478,070 | 12/1995 | Morrison . | |
| 5,536,004 | 7/1996 | Wiseman et al. . | |

*Primary Examiner*—Sebastiano Passaniti
*Attorney, Agent, or Firm*—Ratner & Prestia

[57] ABSTRACT

A practice batting tee that includes a base having a first shaft mounted on a sliding member which slides from side to side on the base. The height of the first shaft is adjustable. Rotatably mounted on top of the first shaft are two baseballs connected by a rod. The base also has a recessed region for receiving an adjustable platform. A second shaft and a third shaft are mounted on the adjustable platform and adjusted to teach the hitter to swing in a slight downward motion. The second shaft and third shaft may be coupled together using a sliding member attached to the top of the first and second shaft. The second and third shaft are connected to a platform that can be moved towards or away from the first shaft and can be moved clockwise or counter-clockwise in order to be "in line" with the first shaft.

17 Claims, 4 Drawing Sheets

PRACTICE BATTING TEE AND A METHOD THEREOF

FIELD OF THE INVENTION

This invention relates generally to a practice device for baseball or softball and, more specifically, to a batting practice tee.

BACKGROUND OF THE INVENTION

Each professional season few major league baseball players achieve a batting average of 0.300 or better (a "3-hundred hitter") with the average major leaguer batting only about 0.250. Typically, a 3-hundred hitter is a contact-type hitter who hits ground balls and line drives and avoids strike-outs, pop-ups, and long fly balls. A contact hitter characteristically swings at and connects with the pitched ball in a slight downward motion when bringing the bat from the "launch position" to contact with the ball. The "launch position" is the position of the hands at the point in time that the front foot lands after the batters strides toward the pitcher. Also, the contact hitter times his swing to meet the baseball in front of home plate, rather than waiting for the ball to cross the plate. In addition, this type of hitter utilizes full extension of his arms and shifts his weight during the swing so he is properly balanced to strike the oncoming pitch with maximum effectiveness.

While the hitter is in motion to contact the pitch, it is crucial that the hitter maintains complete concentration and continuous eye contact with the ball. In this way, the hitter can react to and swing at the ball even if it has varying movement, such as an inside-to-outside motion, high-to-low motion, or a combination of these motions brought about by the pitch being, for example, a curve ball, a slider, or a sinker.

One prior art practice batting tee is disclosed in U.S. Pat. No. 4,819,937 entitled COMBINED BATTING TEE AND STRIKE INDICATOR and issued to James Gordon. The batting tee includes first and second adjustable stanchions or poles mounted on a base plate and extender members. The second stanchion has a support for resting a baseball. Because of the placement of the second stanchion relative to home plate, the hitter contacts the baseball in front of home when he assumes the normal hitter's stance at home plate. The first stanchion is positioned and adjusted relative to the second stanchion to affect the desired swing.

The stanchions can be placed at selected locations on the base plate and adjusted in height so that the hitter may practice hitting the ball at locations corresponding to, for example, a high in side pitch, or a low inside pitch. This arrangement requires, however, that the first and second stanchions be properly aligned in order to practice the proper swing. The prior art practice batting tee does not provide a mechanism to allow an amateur to properly adjust the first and second stanchion. Further, after taking one practice swing, a new ball must be placed on the second stanchion or the previously hit ball retrieved so that the hitter may practice his next swing. In either case, the hitter is required to disrupt his practice in order to setup the prior art batting tee.

Thus, a need exists for a baseball teaching device that can be used to teach a hitter to develop a slight downward swing thereby hopefully becoming a contact-type hitter. Such a device should be arranged to allow a hitter to adjust the batting tee without the involvement of an expert to ensure that the device is properly aligned. Further, such a device should allow the hitter to repeatedly practice his swing without interruptions to realign or setup the batting tee for use.

SUMMARY OF THE INVENTION

To achieve these and other objects in view of its purposes, the present invention provides a practice batting tee that includes a base having a first shaft mounted on a sliding member which slides from side to side on the base. The height of the first shaft is adjustable. Rotatably mounted on top of the first shaft are two baseballs connected by a rod. The base also has a recessed region for receiving an adjustable platform. A second shaft and a third shaft are mounted on the adjustable platform and adjusted to teach the hitter to swing in a slight downward motion. The second shaft and third shaft may be coupled together using a sliding member attached to the top of the first and second shaft.

The present invention further relates to batting practice method for a hitter using a bat having a knob. The method includes the step of providing a first shaft, a second shaft, and a third shaft. The method also includes the steps of adjusting a height of the first shaft and adjusting a height of the third shaft to a height of the knob of the bat held by the hitter. Also provided is a step for adjusting a height of the second shaft to a height below a line of sight extending from the height of the first shaft to the height of the third shaft.

It is to be understood that both the foregoing general description are exemplary, but are not restrictive, of the invention.

BRIEF DESCRIPTION OF THE DRAWING

The invention is best understood from the following detailed description when read in connect with the accompanying drawing. It is emphasized that, according to common practice, that various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
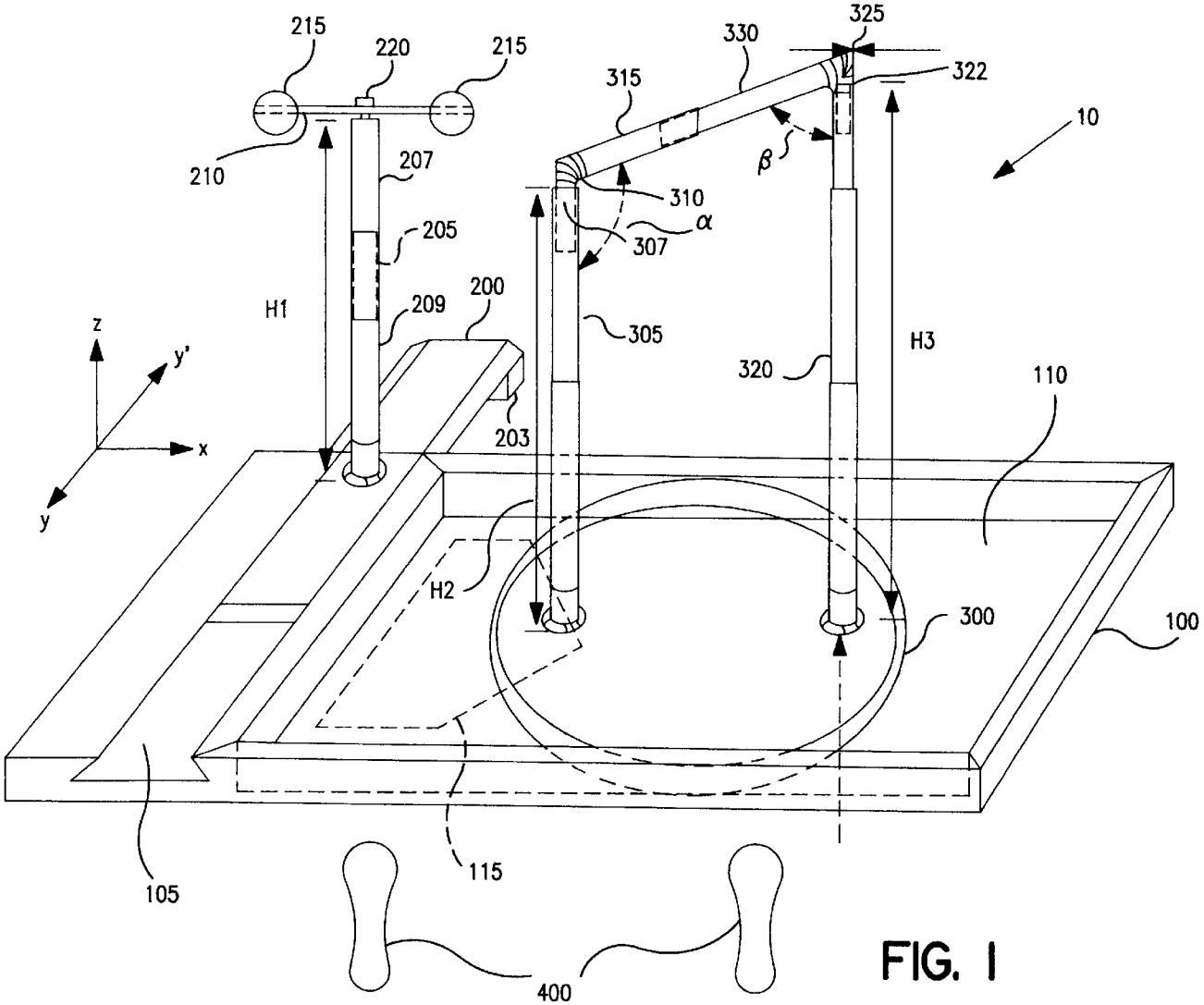
FIG. 1 is a perspective view of the practice batting tee 10 according to an exemplary embodiment of the present invention.

Referring now to the drawing, wherein like reference numerals refer to like elements throughout, FIG. 1 shows a perspective view of a practice batting tee 10 according to an exemplary embodiment of the present invention. The practice batting tee 10 includes a base 100 having a first shaft 205 mounted on a sliding member 200. The sliding member 200 is moveable in the y-direction and y'-direction. The sliding member 200 may also include a stop 203 to prevent the sliding member 200 from moving beyond a predetermined position with respect to the base 100 in the y-direction and y'-direction. The stop 203 also serves as a base for sliding member 200 as it is moved in the y-direction or y'-direction. The sliding member 200 is received in a recess 105 formed in the base 100. The recess 105 has an open triangular shape.

When the sliding member 200 is positioned in the recess 105, the sliding member 200 is prevented from moving in the x and z-directions with respect to the base 100. Alternatively, the sliding member 200 may be coupled to the base 100 by other means such as bolts and nuts. In this case, slots would be formed in the base 100 and an opening would be formed in the sliding member 200. The bolts would be positioned in the opening in the sliding member 200 and through the slot formed in the base 100. The slot allows the sliding member 200 to be moved in the y-direction or y'-direction with respect to the base 100. Once the sliding member 200 is in position, the bolts and nuts are tightened to hold the sliding member 200 in position. The sliding member 200 can be removed from recess 105 and reinserted from the opposite side of base 100 to accommodate a left handed batter and moved in the y-direction or y'-direction.

The shaft 205 has a substantially vertical orientation relative to the base 100. Rotatably mounted on top of the first shaft 205 are two baseballs, softballs, or simulated baseballs or softballs (hereinafter "baseballs") 215 connected by a rod 210. Alternatively, one baseball 215 may be mounted on a rod 210 extending from the top of shaft 205 to the baseball 215. The rod 210 is coupled to the first shaft 205 using, for example, a pin 220 which allows the baseballs 215 to rotate freely and substantially parallel to the x-y plane.

The height H1 of the first shaft 205 is adjustable so that the height of the baseballs/softballs 215 may be adjusted. The first shaft 205 is, for example, a telescoping friction tube structure including a first column 207 and a second column 209. The height H1 of the first shaft 205 is adjusted by applying downward or upward pressure on first column 207 in the z-direction which moves the first column 207 in the z-direction relative to the second column 209. Once the desired height Hi of the shaft 205 is obtained, no further pressure is applied and the first column 207 is held in place by friction. Alternatively, there may be a third or fourth column in addition to the first column 207 and the second column 209 to achieve the desired height.

Although the exemplary embodiment utilizes frictional contact between the first column 207 and the second column 209 to position and maintain the height adjustment of the first shaft 205, it is possible for one skilled in the art to contemplate other equivalent arrangements. For instance, a spring-loaded pin could be inserted into periodically formed and aligned holes cut into horizontally through each of the sleeves. Alternatively, a bolt, clamp, or clip, may be used to couple the first column 207 to the second column 209 and adjust the height H1 of the first shaft 205. The first shaft 205, the second shaft 305, and the third shaft 320 may be formed of rubber that is strong enough to maintain its shape yet durable and flexible enough to withstand numerous blows either direct or glancing, from a hitter.

A rectangular recess 110 is formed in the base 100. Received in the rectangular recess is an adjustable platform 300. The adjustable platform 300 is, for example, circular shaped. A second shaft 305 and a third shaft 320 are mounted on top of the adjustable platform 300. The height H2 of the second shaft 305 and the height H3 of the third shaft 320 are adjustable. The second shaft 305 and the third shaft 320 are, for example, telescoping friction tube structures as described above with regard to the first shaft 205. Alternatively, a bolt, clamp, or clip, may be used for the second shaft 305 and the third shaft 320 as described above with regard to the first shaft 205.

A first sliding member 315 is coupled to the top of the second shaft 305 using a first flexible member 310 which is received in an opening 307 formed in the second shaft 305. An angle $\alpha$ is formed between the sliding member 315 and the second shaft 305. A second sliding member 330 is coupled to the third shaft 320 using a flexible member 325 which is received in an opening 322 formed in the third shaft 320. An angle $\beta$ is formed between sliding member 330 and third shaft 320. The sliding member 330 and the sliding member 315 may be adjustably coupled to each other. When the height H2 of the second shaft and the height H3 of the third shaft 320 are adjusted, the sliding members 330 and 310 move with respect to each other allowing the heights H2 and H3 to be adjusted freely and independently.

In operation, the height HI of the first shaft 205 is adjusted for the hitter to begin practice. The sliding member is adjusted in the y-direction or y'-direction relative to a home plate 115 formed in the recess 110. The placement and heights H2 and H3 of the second shaft 305 and the third shaft 320 are then adjusted relative to the height of first shaft 205 to ensure that the hitter swings with a downward swing motion. The adjustments of the first shaft 205, second shaft 305, and third shaft 320 are described below with reference to FIGS. 2 and FIGS. 3. Components of the batting tee 10 have been omitted from FIGS. 2 and 3 for clarity.

Figure 2:
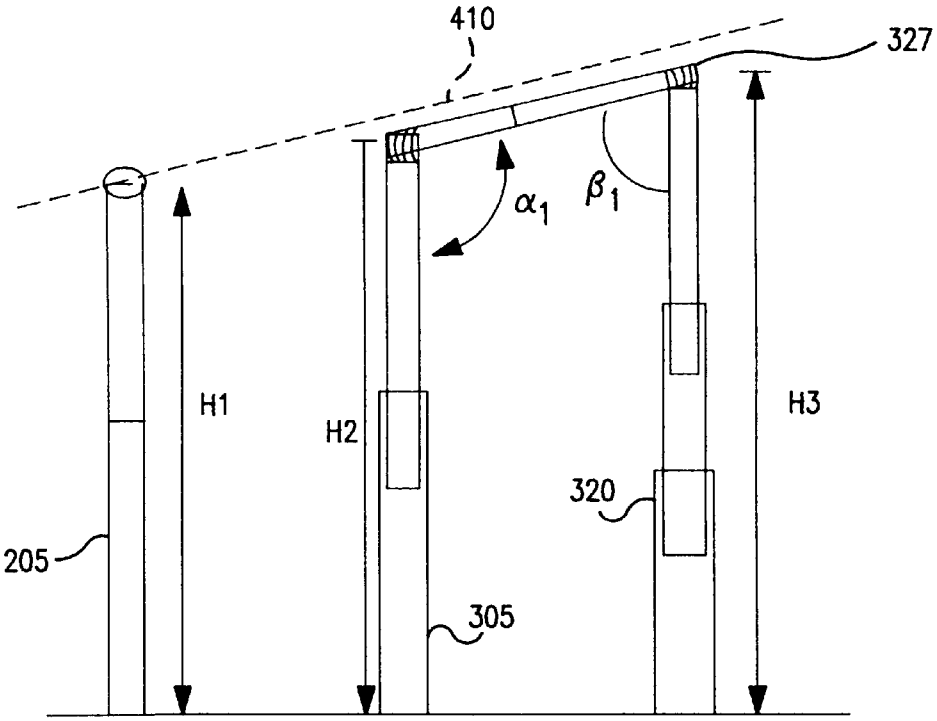

As is shown in FIG. 2, the height of the first shaft 205 is positioned at a first height HI. The third shaft 320 is adjusted to a height H3 so that the top 327 of the third shaft 320 corresponds to the knob of the bat held by the hitter when the hitter is positioned in the "launch position" at the practice batting tee 10. The knob of the bat is the end of the bat closest to the hitter's hands when the bat is held by the hitter. The placement of the batter's feet 400 relative to the practice batting tee 10 is shown in FIG. 1. Returning to FIG. 2, the height H2 of the second shaft 305 is adjusted so that it is just below the line of sight line 410 from the top 327 of the third shaft 320 to the baseball 215. The height H2 of the second shaft 305 and the height H3 of the third shaft 320 are adjusted such that they are positioned lower than the batter's swing. Alternatively, the second shaft 305 may be adjusted so that the first sliding member 315 and the second sliding member 330 are substantially parallel to the line of sight line 410 from the top 327 of the third shaft 320 to the baseball 215.

By using this alignment process, the height of the second shaft 305 and the third shaft 320 are adjusted to aid the batter's practice of a downward swinging motion at the baseball 215 desired of a contact-hitter. Further, an amateur may adjust the practice batting tee 10 for the proper downward swinging motion without the aid of an expert.

Figure 3:
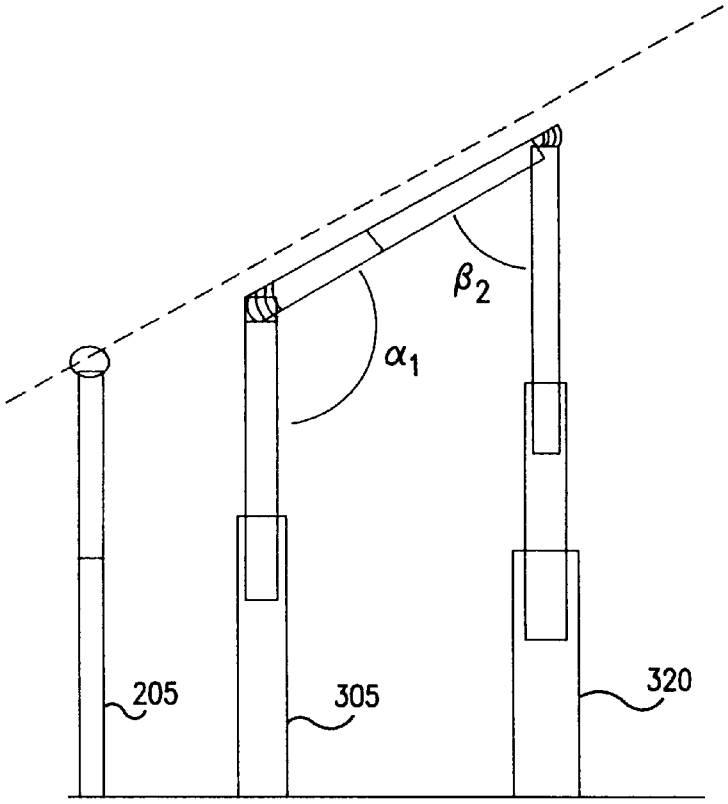
FIGS. 2 and 3 are schematic diagrams illustrating the adjustment of the second shaft 305 and the third shaft 320.

FIG. 3 is a diagram of the first shaft 205, the second shaft 305, and the third shaft 320, where the height H1 of the first shaft 205 has been lowered to represent a low pitch. The heights H2 and H3 of the second shaft 305 and the third shaft 320 are adjusted as described above with regard to FIG. 6 and, as a result, the following relations result between the angles $\alpha$ and $\beta$ as the baseball 215 is lowered via first shaft 205:

$$\beta 1>\beta 2 \text{ and } \alpha 1<\alpha 2$$

In addition to adjusting the height H2 and H3 of the second shaft 305 and the third shaft 320, the adjustable platform 300 may be adjusted depending upon the position of the sliding member 200 with respect to the base 100. The rotation of the adjustable platform 300 is described below with reference to FIGS. 4 and 5. Components of the batting tee 10 have been omitted from FIGS. 4 and 5 for clarity.

Figure 4:
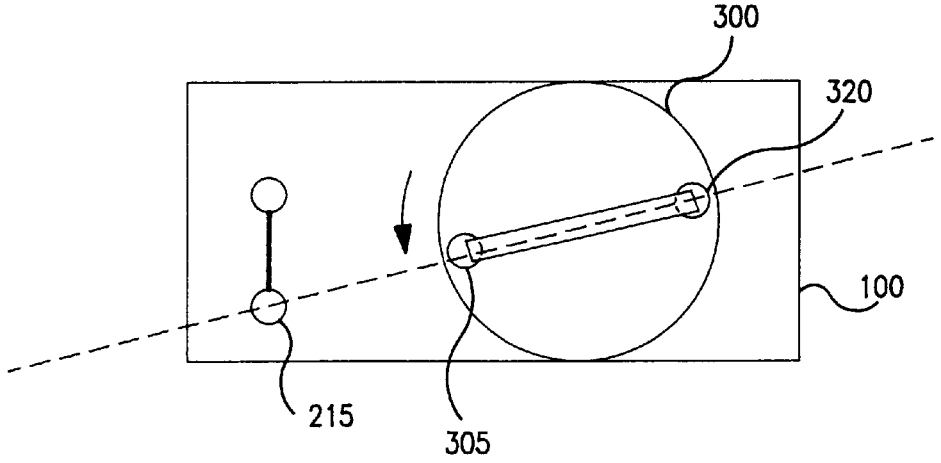
FIGS. 4 and 5 are top views of the practice batting tee 10 useful for illustrating the rotation of the adjustable platform 300.
Figure 5:
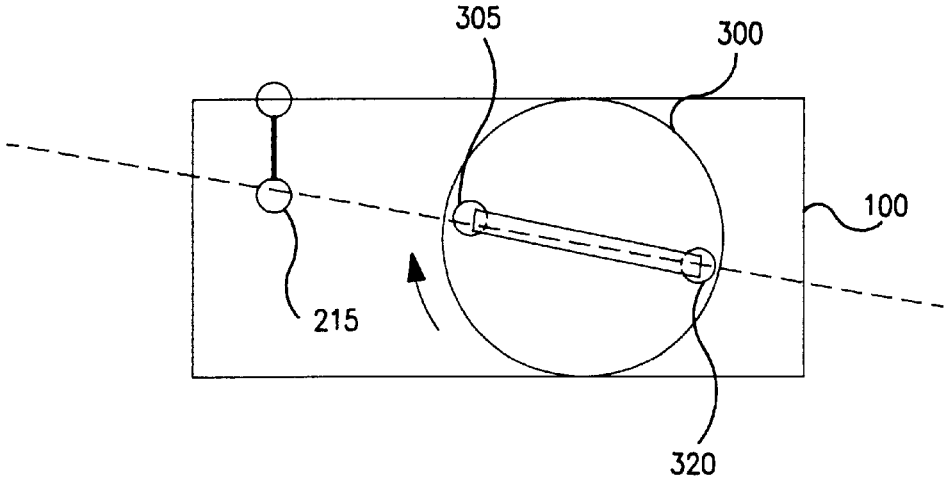

As is shown in FIGS. 4 and 5, when the baseballs 215 are moved to a first position with respect to the base 100, the adjustable platform 300 is rotated so that the baseball 215, second shaft 305, and the third shaft 320 are in line. As is shown respectively in FIGS. 4 and 5, the adjustable platform 300 may be rotated, for example, counter clockwise or clockwise to align the second shaft 305 and the third shaft 320 with the baseball 215.

Figure 6:
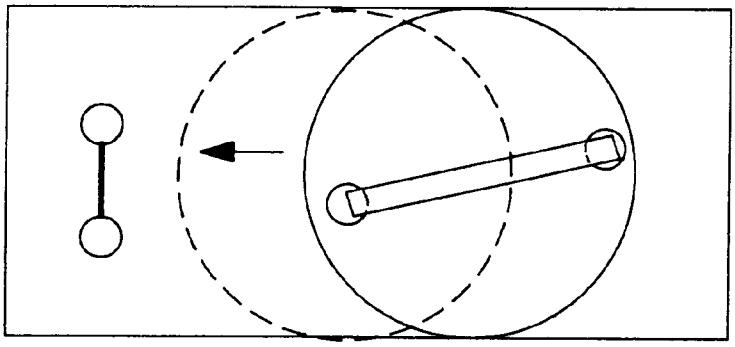
FIGS. 6 and 7 are top views of the practice batting tee useful for illustrating the forward and backward adjustments of the adjustable platform 300.
Figure 7:
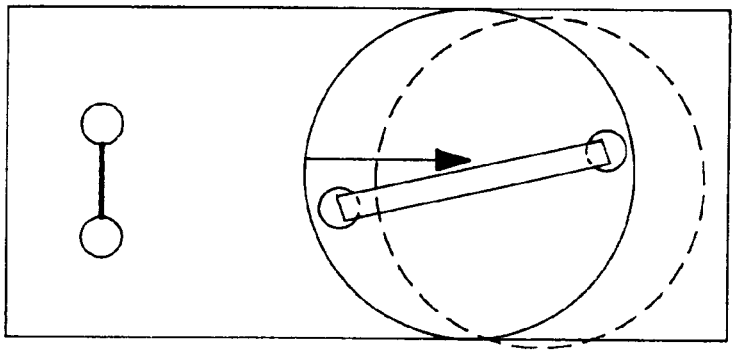

FIGS. 6 and 7 illustrate the movement of the adjustable platform 300 in the x-direction with respect to the base 100 to align the second shaft 305 and the third shaft 320. Components of the batting tee 10 have been omitted from FIGS. 6 and 7 for clarity. As is shown in FIG. 6, the adjustable platform 300 can be moved towards the baseballs 215 or, as shown in FIG. 7, the adjustable platform 300 can be moved away from the baseballs 215. As a result, the adjustable platform 300 can be placed in a position to accommodate a batter's stance at the home plate 115, shown in FIG. 1, while ensuring that the hitter swings with a down swinging motion desired of a contact hitter.

Once the practice batting tee 10 is aligned, the hitter swings at the baseball 215. The hitter knows to adjust his swing if he hits the second shaft 305, the third shaft 320, the first sliding member 315, or the second sliding member 330 during his swing. As a result, the hitter is provide an indication that his swing should be adjusted.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A batting tee comprising:

a first shaft having an adjustable height and a top end;

a baseball rotatably mounted on the top end of the first shaft;

a third shaft having an adjustable height; and a second shaft disposed between the first shaft and the third shaft, the second shaft having an adjustable height, wherein the first shaft, the second shaft, and the third shaft are substantially linearly aligned.

2. The batting tee according to claim 1 further comprising a base and wherein the second shaft and the third shaft are each mounted on the base and the first shaft is moveable mounted on the base so that the first shaft may be moved in a first direction with respect to the base.

3. The batting tee according to claim 2 wherein the third shaft and the second shaft are adjustably mounted on the base so that the second shaft and the third shaft may be moved in a second direction which is substantially perpendicular to the first direction.

4. The batting tee according to claim 3 further comprising a rotatable platform disposed on the base, wherein the second shaft and the third shaft are mounted on the rotatable platform.

5. The batting tee according to claim 1 further comprising a rotatable platform disposed on the base, wherein the second shaft and the third shaft are mounted on the rotatable platform.

6. The batting tee according to claim 1 wherein the second shaft is coupled to the third shaft by a sliding member, and the sliding member is adapted to move between the second shaft and the third shaft.

7. A batting tee comprising:

a base;

a first shaft having an adjustable height and a top end;

a baseball rotatably mounted on the top end of the first shaft;

a third shaft having an adjustable height;

a second shaft disposed between the first shaft and the third shaft, the second shaft having an adjustable height; and a rotatable platform disposed on the base where the second shaft and the third shaft are mounted on the rotatable platform.

8. The batting tee according to claim 7 wherein the first shaft is moveable mounted on the base so that the first shaft may be moved in a first direction with respect to the base.

9. The batting tee according to claim 8 wherein the rotatable platform is movably mounted on the base so the rotatable platform may be moved in a second direction which is substantially perpendicular to the first direction.

10. A batting practice method for a hitter using a bat having a knob held by the hitter at a predetermined height, the batting practice method comprising the steps of:

(a) providing a first shaft having a top end and a baseball rotatably mounted on the top end, a second shaft, and a third shaft;

(b) adjusting a height of the first shaft;

(c) adjusting a height of the third shaft to the predetermined height of the knob of the bat held by the hitter;

(d) adjusting a height of the second shaft to a height below a line of sight extending from the height of the first shaft to the height of the third shaft; and (e) swinging the bat along the line of sight at the baseball disposed on the top end of the first shaft.

11. The batting practice method according to claim 10 wherein step (a) includes the step of providing a rotatable platform, the second shaft and the third shaft mounted on the rotatable platform, the batting practice method further comprising the step of (f) rotating the rotatable platform to align the second shaft and the third shaft with the first shaft.

12. The batting practice method according to claim 11 further comprising the step of (f) moving the rotatable platform one of (1) towards the first shaft and (2) away from the first shaft.

13. The batting practice method according to claim 10 further comprising the step of (f) moving the second shaft and the third shaft one of (1) towards the first shaft and (2) away from the first shaft.

14. A batting practice method for a hitter using a bat having a knob held by the hitter at a predetermined height, the batting practice method comprising the steps of:

(a) providing a first shaft, a second shaft having a top, and a third shaft having a top;

(b) providing a sliding member between the top of the second shaft and the top of the third shaft;

(c) adjusting a height of the first shaft to a first height below the predetermined height of the knob of the bat held by the hitter;

(d) adjusting a height of the third shaft to the predetermined height of the knob of the bat held by the hitter;

(e) adjusting a height of the second shaft so that the sliding member is substantially parallel to a line of sight extending from the height of the first shaft to the height of the third shaft; and (f) swinging at a baseball disposed on the first shaft.

15. The batting practice method according to claim 14 wherein step (a) includes the step of providing a rotatable platform, the second shaft and the third shaft mounted on the rotatable platform, the batting practice method further comprising the step of (f) rotating the rotatable platform to align the second shaft and the third shaft with the first shaft.

16. The batting practice method according to claim 15 further comprising the step of (g) moving the rotatable platform one of (1) towards the first shaft and (2) away from the first shaft.

17. The batting practice method according to claim 14 further comprising the step of (g) moving the second shaft and the third shafts one of (1) towards the first shaft and (2) away from the first shaft.

* * * * *

UNITED STATES PATENT AND TRADE MARK OFFICE

CERTIFICATE OF CORRECTION

PATENT NO. : 5.951,413
DATED : September 14, 1999
INVENTOR(S) : Salvatore Guerriero

It is certified that error appears in the above-identified patent and that said Letters Patent is hereby corrected as shown below:

At column 7, line 1, after "to", insert --linearly--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*